US005685766A

United States Patent [19]

Mattingly et al.

[11] Patent Number: 5,685,766

[45] Date of Patent: Nov. 11, 1997

[54] POLISHING CONTROL METHOD

[75] Inventors: Wayne Mattingly, Canyon Country, Calif.; Hatsuyuki Arai, Zama, Japan

[73] Assignee: Speedfam Corporation, Des Plaines, Ill.

[21] Appl. No.: 564,967

[22] Filed: Nov. 30, 1995

[51] Int. Cl.[6] ..... B24C 1/08

[52] U.S. Cl. ..... 451/36; 451/41; 451/59; 451/5; 451/9

[58] Field of Search ..... 156/636.1, 637.1; 340/680; 451/5, 8, 9, 10, 11, 36, 41, 59, 287, 288, 290

[56] References Cited

U.S. PATENT DOCUMENTS

| | | | |
|---|---|---|---|
| 4,141,180 | 2/1979 | Gill, Jr. et al. . | |
| 4,211,041 | 7/1980 | Sakulevich et al. | 451/287 |
| 4,272,924 | 6/1981 | Masuko et al. | 451/269 X |
| 4,680,893 | 7/1987 | Cronkhite et al. . | |
| 5,069,002 | 12/1991 | Sandhu et al. . | |
| 5,224,304 | 7/1993 | Cesna . | |
| 5,240,552 | 8/1993 | Yu et al. | 156/636 |
| 5,245,794 | 9/1993 | Salugsugan | 451/287 X |
| 5,265,378 | 11/1993 | Rostoker | 451/41 X |
| 5,329,732 | 7/1994 | Karlsrud et al. . | |
| 5,562,529 | 10/1996 | Kishii et al. | 451/41 X |

FOREIGN PATENT DOCUMENTS

35922731 A 12/1984 Japan .

*Primary Examiner*—Timothy V. Eley

*Attorney, Agent, or Firm*—Fitch, Even, Tabin & Flannery

[57] ABSTRACT

Polishing of wafers, such as wafers of semiconductive material is carried out by mounting the wafer to a carrier, and pressing the wafer against a polishing pad carrying a polishing media. An antenna is placed beneath the polishing pad and electrical energization is applied between the carrier assembly and the antenna. The electrical energization preferably includes a direct current bias, but may also include ratio frequency carrier injection signal. The noise associated with ionic disassociation is monitored to assess ongoing polishing activity, on a real time basis.

14 Claims, 4 Drawing Sheets

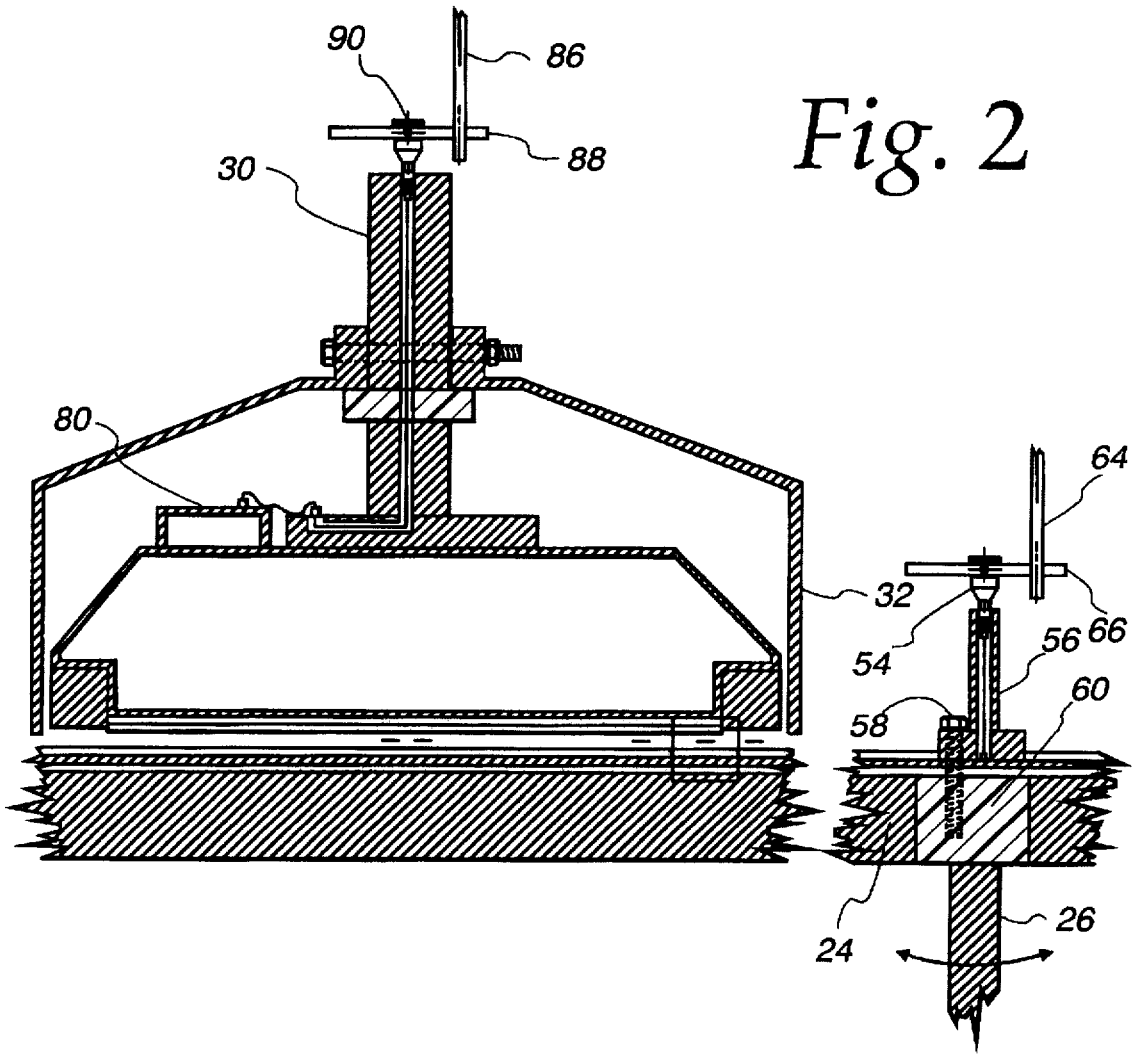
Fig. 2
Fig. 3
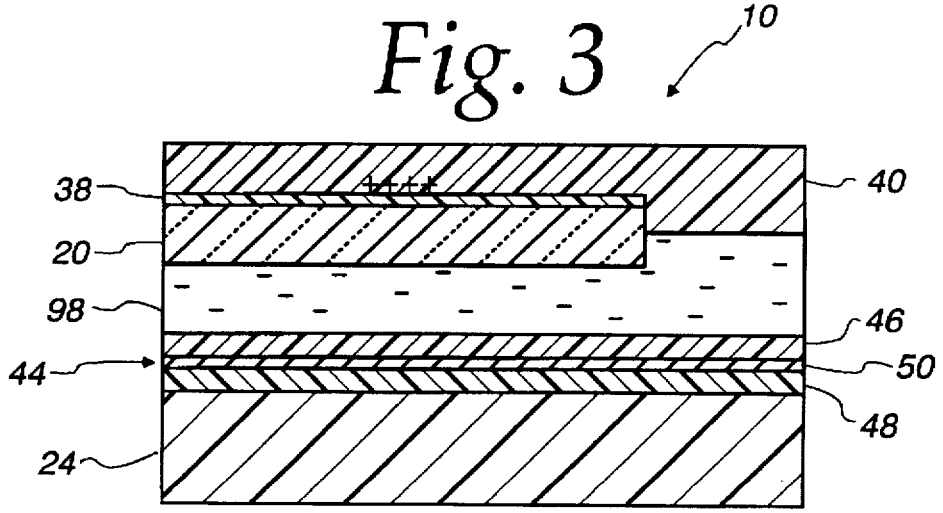

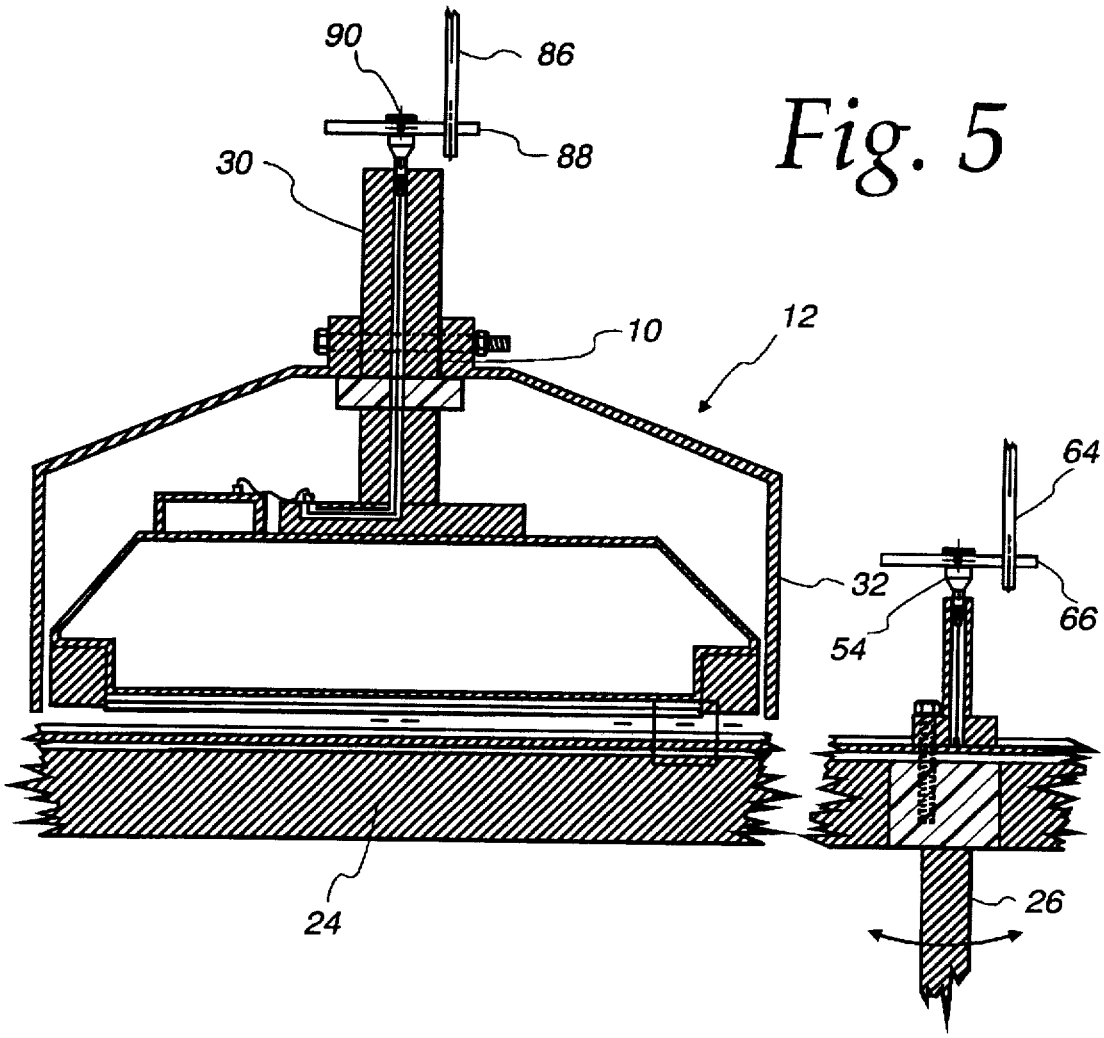
Fig. 5
Fig. 6
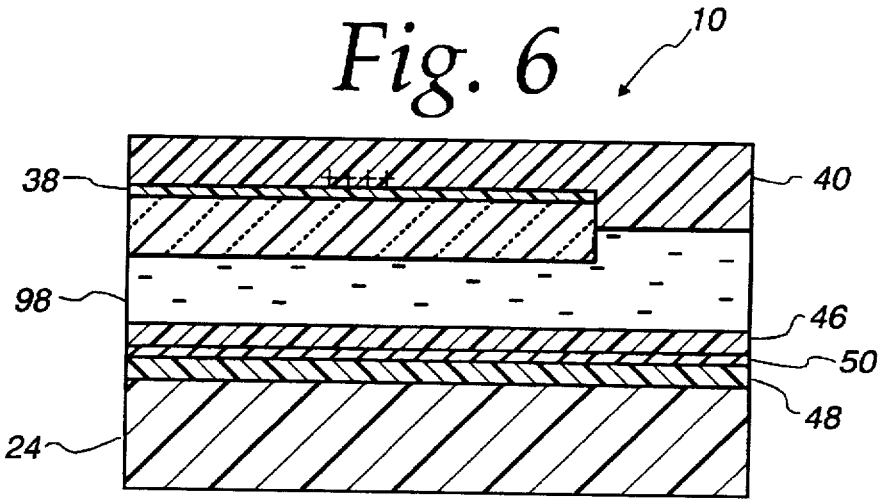

POLISHING CONTROL METHOD

BACKGROUND OF THE INVENTION

1. Field of the Invention

The present invention pertains to polishing of wafers, and in particular to the polishing of wafers using free abrasive machining techniques.

2. Description of the Related Art

The polishing of thin, flat disks has been practiced for some time. Some of the earlier work was done with disks of glass material. Recently, however, semiconductor and other electronics-related materials of significant commercial importance have received similar treatments.

Semiconductive materials such as electronics-grade silicon is very costly, warranting unusual measures to reduce or eliminate failures arising during manufacture. Consider, for example, silicon wafers having solid state structure formed therein, such as metallic layers. Such structures are sometimes encapsulated within the silicon disk so as to be electrically insulated from the surrounding environment.

In one type of polishing-related production technique, silicon disks are machined using free abrasive processes to flatten at least one major surface of the disk. Such flattening is carried out to a high degree of accuracy, so as to produce what is commonly termed a "mirror surface" or an "optically flat" surface. The same processes are sometimes referred to as "planarization" techniques. Flattening of the major surface of the disk is accomplished by removing the "high spots" which project above a theoretical reference plane. Hopefully, such theoretical reference plane will allow the structures in the wafer to remain covered. The challenge is then to polish the wafer enough to achieve the flatness desired, but not to polish the wafer excessively so as to expose hidden structures. While there are a number of polishing or grinding machines readily available for this purpose, there is still a need to develop operating techniques for polishing and similar equipment to accurately control the amount of material removed from a disk or other workpiece.

SUMMARY OF THE INVENTION

It is an object of the present invention to provide methods and apparatus for operating polishing and similar machines.

Another object of the present invention is to provide nondestructive testing of a wafer being polished, or its optical flatness, using low cost equipment.

Another object of the present invention is to provide methods and apparatus for polishing thin wafers to a desired degree of flatness.

A further object of the present invention is to provide methods and apparatus for polishing thin wafers having internal structures, without damaging the internal structures.

Yet another object of the present invention is to provide methods and apparatus for controlling polishing and similar operations with real time monitoring of the ongoing polishing activity so as to determine when a desired result has been achieved, and so as to terminate further polishing.

These and other objects according to principals of the present invention are provided in apparatus for polishing a workpiece, comprising:

a nonconductive table;

a carrier assembly disposed above the table for carrying the workpiece to be polished;

means for moving at least one of the table and carrier assembly with respect to the other;

a polishing pad carried on the table;

an antenna comprising a thin flexible sheet of conductive material between the pad and the table;

electrical energization means coupled between the carrier assembly and the antenna; and the polishing pad being sufficiently thin and being adapted to allow ionic disassociation generated by the polishing activity to be detected by the carrier.

BRIEF DESCRIPTION OF THE DRAWINGS

FIG. 2 is a fragmentary cross-sectional view of FIG. 1 shown on an enlarged scale;

FIG. 3 is a fragmentary cross-sectional view showing a portion of FIG. 2 on an enlarged scale;

FIG. 5 is a fragmentary cross-sectional view thereof on an enlarged scale; and FIG. 6 is a fragmentary enlarged view of FIG. 5, shown on an enlarged scale,

DETAILED DESCRIPTION OF THE PREFERRED EMBODIMENTS

Figure 1:
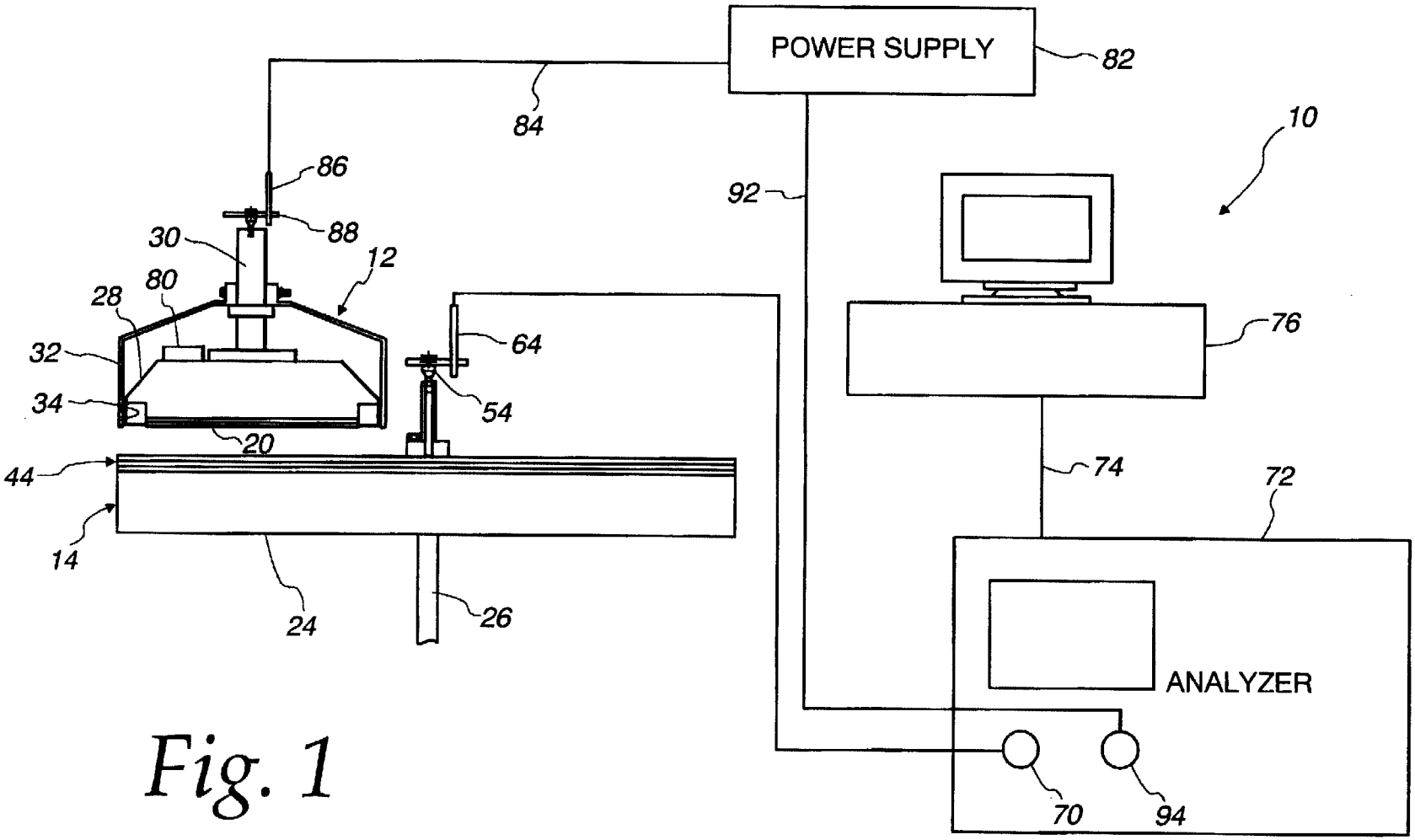
FIG. 1 is a-schematic drawing of a mounting head and polishing Gable arrangement according to principles of the present invention.

Referring now to the drawings, FIG. 1 shows a polishing station with polishing apparatus generally indicated at 10. The polishing station includes a mounting head generally indicated at 12 and a support table generally indicated at 14. A workpiece or wafer 20 to be polished is carried by the mounting head. As will be seen herein, the present invention can be applied to workpieces of different material composition and varying thickness. The present invention has found immediate commercial acceptance for polishing workpieces comprising a relatively thin disk of semiconductive material, especially silicon wafers having a thickness ranging between 0.5 mil to 5 mils.

In general, the polishing apparatus operates on a major surface of the wafer carried in the mounting head. In the preferred embodiment, the wafer is "planarized", i.e., made flat enough so as to remove virtually all depressions formed below a theoretical target plane, to an accuracy on the order of several angstroms. The wafer 20 may contain internal structures such as metallized layers or layers of dissimilar semiconductive material, although this is not necessary. However, if internal structures are present within wafer 20, the present invention can be relied upon to aid in avoiding unnecessary damage (e.g., exposure at an outer surface of the wafer).

As will be seen herein, the present invention is concerned with monitoring extremely low level signals. In the preferred embodiment, the signals lie in the nanovolt range and care must be taken to preserve the signal integrity, while providing a test arrangement in which conventional, economical equipment can readily discriminate the test signal from background noise originating not only from the polishing equipment, but also from equipment operated by neighbors. Referring to FIG. 1, the table generally indicated at 14 includes a nonconductive table bed 24 mounted for rotation on a support column 26.

A mounting head 12 includes a carrier assembly 28 mounted for rotation and for vertical linear movement on an upper support column 30. In the preferred embodiment, a plurality of mounting heads 12 are provided for use with the table assembly 14. The table assembly and mounting head are of conventional construction and may, for example, comprise any of a number of polishing or grinding machines available from SpeedFam Corporation, assignee of the present invention, located in DesPlaines, Ill.

One example of a polishing apparatus is given in U.S. Pat. No. 5,329,732, assigned to the assignee of the present invention. Certain additional features are added to a conventional mounting head, as will be described herein. As will be seen, some of these features relate to electrical energization of the mounting head with a radio frequency carrier signal and/or a direct current voltage signal.

The mounting head 12 is schematically illustrated in FIG. 1, and includes a carrier 34 of the type used to hold wafers, disks and other items during wet lapping and polishing processes or alternatively for planarization and texturizing processes. Referring additionally to FIG. 3, the carrier 1 uses a backing pad or film 38 of conventional material, such as urethane elastomers, laminated to part holders 40, such as ring-like structures made of fiberglass or other insulating material. The backing pad 38 cushions the wafer 20 from its holder. In a single-sided polishing of wafers, such as that illustrated, the carriers may be mounted to polishing chucks to contain parts during processing, and to allow rapid handling of parts during a production run. When polishing chucks are employed, they may be of the vacuum operated type which maintains the part holder 40 and associated wafer 20 by vacuum forces. Accordingly, holes are typically punched through the backing pad 38 so that a vacuum force can be applied to the wafer 20, as well as the part holder 40.

The present invention has found immediate commercial application for use with a special type of polishing referred to as "planarization." In these types of operations, the polishing machine is operated so as to flatten relatively bumpy films of oxide, metallic or resinous layers over devices, such as components grown on semiconductor Wafers. Since the wafers are not always flat, polishing processes are typically carefully controlled to maintain a uniform film thickness across the wafer diameter. In operation of the polishing machine, the mounting head 12 is pressed in a downward direction against table assembly 14.

Referring to FIG. 3, the table bed 24 is covered with a pad arrangement against which the wafer 20 is pressed during a polishing operation. In the preferred embodiment, the pad arrangement, generally indicated by the reference numeral 44, includes an upper pad 46 facing the mounting head 12 and a lower pad 48 in contact with the table bed 24. The polishing pad 46 preferably comprises commercially available Rodel Model No. IC-60 or IC-1000 series pads. When planarization of the wafers is desired, it is preferred that the polishing pads have a hard surface character while being flexible over the width of the wafer to be polished, so as to accommodate undulations (i.e., global variance) in the wafer. In addition, the polishing pads 46, 48 are preferably highly wettable so as to enhance polishing uniformity. The backing pad 48 preferably comprises Rodel Model No. Suba IV filter paper or very uniform thickness felt (approximately 1/16 inch) to take up size variations, parallel variations and out-of-flatness variations of the wafer being polished.

In the preferred embodiment, an antenna member 50 is located between the pads 46, 48. The antenna member 50 is preferably comprised of a thin aluminum film, thin enough to readily allow flexing of the overlying IC-1000 pad and underlying Suba IV pad. The antenna member could also be made of stainless steel, as well as metals and metal alloys which provide a low corrosion conductor film having flexing characteristics compatible with those of the overlying polishing pad 46 and underlying backing pad 48.

The top pad 46 provides a polishing surface, while the underlying pad 48 allows the pad 46 to readily conform to the characteristics of a wafer being polished. In the preferred embodiment, the pads 46, 48 are of a standard size, 24 inches in diameter, while the antenna member 50 was constructed to have a diameter of 23 inches. The pad arrangement 44 can be readily accommodated by conventional polishing table equipment, without requiring substantial modifications of the table bed 24 and associated drive mechanisms. However, since one design goal of the polishing apparatus was to promote reliable detection of faint signals, i.e., signals having a very low signal strength, the antenna and table members must be compatible with relatively noiseless contacts used to couple electronic equipment to the antenna member 50.

As mentioned above, the radio frequency carrier signal passes through the polishing pad 46. In order to enhance the signal detection capabilities of the polishing arrangement, it is preferred that the polishing pad 46 be perforated to allow direct contact of the ionically charged polishing medium with the antenna member 50. Although virtually any pattern of the optional perforations can be employed for the polishing pad 46, it is preferred that the perforations comprise uniformly sized diameter holes formed in the pad, and located on uniformly spaced centers. It is generally preferred that the perforations be generally uniform throughout the working surface of the polishing pad 46.

Referring to FIG. 2, an electrical feedthrough connector 54 is secured atop a conductive mounting block 56. Mounting block 56 is in turn secured by a bolt fastener 58 to a dielectric block 60 mounted in the center of table bed 24. An electrical lead 64 is coupled to bushing 54 through an arm 66. The lead 64 and arm 66 remain stationary, that is, nonrotating, with the arm 66 attached to the upper end of bushing 54. The lower end of bushing 54 rotates with table bed 24, about the axis of support shaft 26. Bushing 54, as mentioned, has first and second interfitting parts which are movable relative to each other, and which employs a liquid conductive medium between the parts for relatively noiseless coupling of an electrical signal through the rotating bushing.

In the preferred embodiment, bushing 54 was obtained from the Mercotac Corporation as commercially available Model No. 205. In this commercially available bushing, the fluid conductive medium comprises mercury. By using a feedthrough bushing having a conductive fluid for electrical coupling, brushes and the like contact devices can be avoided, thus eliminating the noise created by brushes in a rotating machine. By utilizing the fluid filled bushing 54, extremely low level signals were successfully detected, with a reliability for an especially continuous data stream) which allowed the signals to be used on a real time basis for control of the polishing equipment. As schematically indicated in FIG. 1, the electrical lead 64 is coupled to an input terminal 70 of a signal analyzer 72. The signal analyzer 72 is in turn coupled through a bus 74 to a microprocessor 76 which performs data analysis useful, for example, for real time control of the polishing apparatus.

Tuning again to FIGS. 1 and 2, mounting head 12 includes a radio frequency transmitter 80 which causes radio frequency power to be radiated from the antenna 50. Electrical energization of the radio frequency transmitter 80 is provided by a power supply 82 which is coupled through conductor 84 to an electrical lead 86 and arm 88 mounted to the upper end of feedthrough bushing 90. In the preferred embodiment, the feedthrough bushing 90 is similar to the bushing 54 described above. The lower end of bushing 90 is mounted to support column 30, and electrical conductors (not shown) couple the lower end of bushing 90 to the radio frequency transmitter 80. Optionally, power supply 82 may be connected through conductors 92 to an input 94 of signal analyzer 72.

Referring to FIG. 3, a fluid (i.e., flowable) polishing media 98 is disposed between wafer 20 and the upper pad 46. The polishing media can comprise any of a number of commercially available formulations, such as those commercially available from the assignee of the present invention. Alternatively, the polishing media can comprise water or other liquids which are free of added abrasives. Carrier head 12 and table assembly 14 are operated in a conventional manner, with a polishing media 98 covering the pad 46, in preparation for a polishing operation. The carrier head 12 is then lowered until its travel is halted, and pressure is applied as the carrier head and/or table assembly are rotated.

It is believed that the wafer 20 rides on a very thin layer (on the order of a few monatomic layers) of the polishing media 98. In some instances, portions of the wafer 20 may directly contact the pad 46. In any event, mechanical work is performed on the lower surface of wafer 20 in a procedure commonly referred to as Chemical-Mechanical Polishing. An ion charge in the polishing media, arising from frictional atomic disassociation, builds up as polishing progresses. Ionic interactions occur between the wafer 20, the polishing media 98 and the polishing pad 46. The polishing rate can be controlled by altering the down force of the mounting head and the velocity of the polishing media particles. The ion-exchange capacities of the polishing media 98 may also be employed to govern removal rates and, for semiconductor wafers, the surface charge of the wafer is influential in the Chemical-Mechanical Polishing operation.

In the first embodiment of the present invention, a radio frequency carrier signal is transmitted through the wafer, polishing media and polishing pad, and thus is altered to some extent by the ionic activity occurring along its path of travel towards the antenna member 50. A radio frequency shield 32 prevents upward radio frequency leakage and provides shielding of unwanted noise from entering the wafer interface area during polishing.

The altered carrier signal is received by the antenna member 50 and is coupled to input 70 of signal analyzer 72. The carrier noise signal is preferably extracted from the carrier radio frequency using conventional signal demodulation techniques. The signal analyzer 72 observes the noise interference and frequency energy losses associated with polishing activity. As mentioned, the signal is of a very low level, and in the preferred embodiment ranges between 200 nanovolts and several hundred microvolts. The radio frequency transmitter in the preferred embodiment comprised a Hewlett-Packard Model No. 8647A radio frequency generator, while the signal processor 72 comprised Hewlett-Packard Fast Fourier Transform (FFT) signal analyzers, Model No. 35665A. The carrier noise signal is detected and demodulated for further analysis, related to the frequency selective losses in carrier strings, resulting from passing the carrier signal through its path of travel. In general, this first preferred embodiment of the present invention is concerned with radio frequency signal injection rather than signals in the sonic wave regime or other frequency regimes. The radio frequency regime has been found to provide a practical environment for reliably extracting meaningful data concerning polishing progress and rates of polishing, on a real-time basis.

After evaluating several different antenna arrangements, it was found that the antenna member 50 provides signal quality sufficient for the signal analyzer 72 to perform along-side signal detection in the −145 dBm range. However, the carrier noise signal was drowned out by surrounding interference and could not be reliably detected, even using the sensitive signal analyzers described above.

In the preferred embodiment, the carrier noise signal upon analysis was found to comprise a true noise signal whose frequencies ranged between two and two hundred hertz. After evaluation, it was discovered that the noise being observed was created by a large number of widely different sources, including sources located on neighboring properties. While investigating solutions to this problem, it was discovered that the most detrimental noise occurred at or around ground potential. The solution employed in the present invention was to clamp the potential of the carrier or mounting head 12 above ground. Because of the noisy environment of the preferred embodiment, it is preferred that a +9 volt bias be applied to the mounting head 12 through the relatively noiseless feedthrough bushing 90, and that the antenna member 50 be set as its respective ground.

Accordingly, the 9 volt bias signal is applied through two relatively noiseless bushings 90 and 54. A sample of the transmitted carrier signal radiating from radio frequency transmitter 80 is coupled through conductor 92 to input 94 of signal analyzer 72 in order to determine the frequency selective attenuation resulting from transmission of the carrier signal through the wafer/media interface, the polishing media and the media/pad interface as well as the polishing pad 46. It is preferred that the signal samples for input terminal 94 be taken from the carrier assembly 12.

As mentioned above, polishing apparatus could employ either a single carrier assembly 12 or multiple carrier assemblies cooperating with a common table assembly, such as that schematically indicated in FIG. 1. When multiple carrier assemblies are employed, the radio frequencies for different carrier assemblies can be made sufficiently different so as to allow discrimination between the various carrier assemblies simultaneously employed in a given machine.

Figure 4:
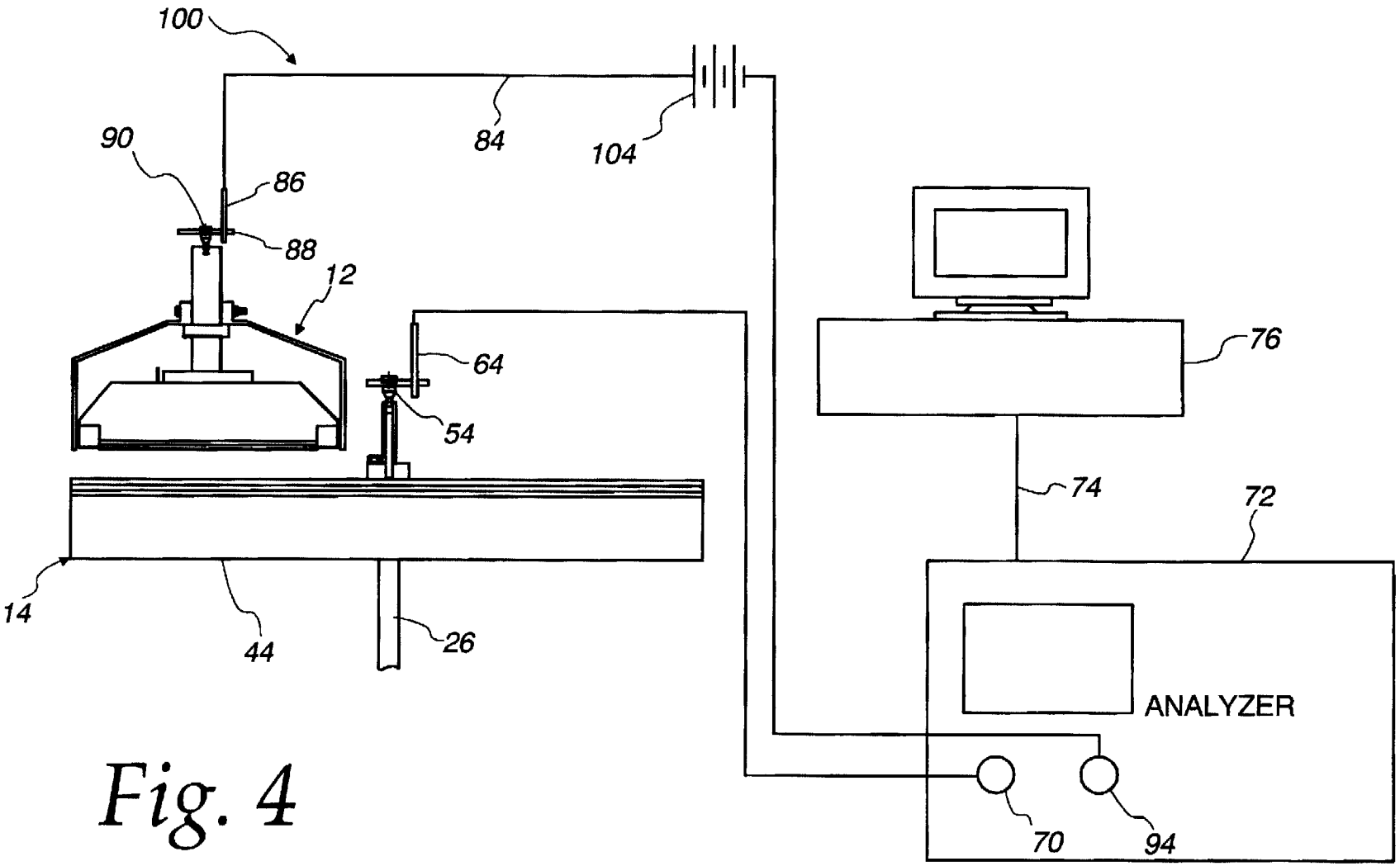
FIG. 4 is a schematic view of an alternative polishing arrangement.

Turning now to FIGS. 4–6, a second embodiment of the present invention is generally indicated at 100. This arrangement is in many respects identical to the arrangement described above with reference to FIGS. 1–3. One significant difference is that the radio frequency transmitter and power supply referred to above are not used. Rather, unlike the polishing arrangement of the preceding embodiment, the polishing arrangement of FIGS. 4–6 passively listens to the noise generated by ionic disassociation. As shown in FIG. 4, a direct current bias indicated by a battery 104 is applied to the carrier assembly 12 through the rotating bushing 90. The bias source is in turn coupled through circuitry in frequency analyzer 72, between terminals 94, 70 to the antenna member 50 through rotating bushing 54. The electrical noise generated in the area of polishing activity rides the resulting dc bias to the input terminal 70 of signal analyzer 72. The noise signal is preferably analyzed in the same way as described above in the preceding embodiment, with the noise patterns and frequency potentials being monitored for observation of ongoing polishing activity, and especially thickness reduction of the wafer being polished.

As can be seen from the above, the present invention is particularly useful in observing ionic charge disassociation effects on a real time basis, during Chemical-Mechanical Polishing of semiconductor wafers and other commercially important objects.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A method for observing polishing activity on a real time basis, in an ongoing polishing operation, comprising:

providing an electrically nonconductive table;

providing a polishing pad on the table;

providing a carrier assembly disposed above the polishing pad;

carrying a workpiece to be polished in the carrier assembly;

moving at least one of the table and carrier assembly with respect to the other so as to generate a polishing activity between the workpiece and the pad causing a region of ionic disassociation of the workpiece;

disposing an antenna comprising a thin flexible sheet of electrically conductive material between the pad and the table;

injecting a radio frequency carrier signal between the carrier assembly and the antenna, through the region of ionic disassociation of the workpiece with the radio frequency carrier signal being modified by the ionic disassociation associated with the polishing activity; and detecting ionic disassociation generated by the polishing activity with the antenna.

2. The method of claim 1 further comprising the step of disposing a fluid, polishing media between the pad and the workpiece with the region of ionic disassociation associated with the polishing activity at least partly contained in the polishing media.

3. The method of claim 2 further comprising the step of perforating the polishing pad so as to allow the polishing media to directly contact the antenna.

4. The method of claim 1 further comprising the step of fluidically coupling the radio frequency carrier signal to the antenna through a first feedthrough bushing comprising first and second interfitting parts with a fluid conductive medium between the parts.

5. The method of claim 4 further comprising the step of fluidically coupling the radio frequency carrier signal to the carrier assembly through a second feedthrough bushing comprising first and second interfitting parts with a fluid conductive medium between the parts.

6. A method for observing polishing activity on a real time basis, in an ongoing polishing operation, comprising:

providing an electrically nonconductive table;

providing a polishing pad on the table;

providing a carrier assembly disposed above the polishing pad;

carrying a workpiece to be polished in the carrier assembly;

moving at least one of the table and carrier assembly with respect to the other so as to generate a polishing activity between the workpiece and the pad, causing a region of ionic disassociation of the workpiece;

disposing an antenna comprising a thin flexible sheet of electrically conductive material between the pad and the table;

coupling an electrical energization signal between the carrier assembly and the antenna;

detecting ionic disassociation generated by the polishing activity with the antenna; and wherein the electrical energization signal injects a radio frequency carrier signal through the region of ionic disassociation of the workpiece with the radio frequency carrier signal being modified by the ionic disassociation associated with the polishing activity.

7. The method of claim 6 further comprising the step of disposing a fluid, polishing media between the pad and the workpiece with the region of ionic disassociation at least partly contained in the polishing media.

8. The method of claim 7 further comprising the step of perforating the polishing pad so as to allow the polishing media to directly contact the antenna.

9. The method of claim 6 further comprising the step of fluidically coupling the electrical energization signal to the antenna through a first feedthrough bushing comprising first and second interfitting parts.

10. The method of claim 9 further comprising the step of fluidically coupling the electrical energization signal to the carrier assembly through a second feedthrough bushing comprising first and second interfitting parts with a fluid conductive medium between the parts.

11. A method for observing polishing activity on a real time basis, in an ongoing polishing operation, comprising:

providing an electrically nonconductive table;

providing a polishing pad on the table;

providing a carrier assembly disposed above the polishing pad;

carrying a workpiece to be polished in the carrier assembly;

moving at least one of the table and carrier assembly with respect to the other so as to generate a polishing activity between the workpiece and the pad causing a region of ionic disassociation of the workpiece;

disposing an antenna comprising a thin flexible sheet of electrically conductive material between the pad and the table;

coupling a direct current bias voltage across the carrier assembly, the region of ionic disassociation and the antenna;

fluidically coupling the direct current bias voltage to the antenna through a first feedthrough bushing comprising first and second interfitting parts with a fluid conductive medium between the parts; and detecting ionic disassociation, generated by the polishing activity, with the antenna.

12. The method of claim 11 further comprising the step of fluidically coupling the direct current bias voltage to the carrier assembly through a second feedthrough bushing comprising first and second interfitting parts with a fluid conductive medium between the parts.

13. The method of claim 12 further comprising the step of disposing a fluid, polishing media between the pad and the workpiece with the region of ionic disassociation associated with the polishing activity at least partially contained in the polishing media.

14. The method of claim 13 further comprising the step of perforating the polishing pad so as to allow the polishing media to directly contact the antenna.

* * * * *

UNITED STATES PATENT AND TRADEMARK OFFICE

CERTIFICATE OF CORRECTION

PATENT NO. : 5,685,766

DATED : November 11, 1997

INVENTOR(S) : Wayne Mattingly and Hatsuyuki Arai

It is certified that error appears in the above-indentified patent and that said Letters Patent is hereby corrected as shown below:

Column 8, line 58, change "12" to -- 11 --.

Signed and Sealed this

Third Day of March, 1998

*Attest:*

*Attesting Officer*

BRUCE LEHMAN

*Commissioner of Patents and Trademarks*